United States Patent [19]

Forney, Jr. et al.

[11] Patent Number: 4,553,806

[45] Date of Patent: Nov. 19, 1985

[54] COAXIAL ELECTRICAL CONNECTOR FOR MULTIPLE OUTER CONDUCTOR COAXIAL CABLE

[75] Inventors: Edgar W. Forney, Jr., Harrisburg; Richard S. Hogendobler, Camp Hill, both of Pa.

[73] Assignee: AMP Incorporated, Harrisburg, Pa.

[21] Appl. No.: 475,572

[22] Filed: Mar. 15, 1983

[51] Int. Cl.[4] ..... H01R 4/00

[52] U.S. Cl. ..... 339/94 C; 339/177 R; 339/276 R

[58] Field of Search ..... 339/177, 94, 143, 276 R

[56] References Cited

U.S. PATENT DOCUMENTS

| | | | |
|---|---|---|---|
| 3,390,374 | 6/1968 | Forney | 339/276 R |
| 3,517,373 | 6/1970 | Jamon | 339/94 R |
| 3,551,882 | 12/1970 | O'Keefe | 339/177 |
| 3,613,050 | 10/1971 | Andrews | 339/177 R |
| 3,673,546 | 6/1972 | Green et al. | 339/177 R |
| 3,739,076 | 6/1973 | Schwartz | 339/94 R |
| 3,923,367 | 12/1975 | Carter | 339/177 R |
| 3,982,060 | 9/1976 | Avery et al. | 174/75 C |
| 4,400,050 | 8/1983 | Hayward | 339/177 R |

*Primary Examiner*—Gil Weidenfeld
*Assistant Examiner*—David L. Pirlot
*Attorney, Agent, or Firm*—Gerald K. Kita

[57] ABSTRACT

A coaxial electrical connector comprises a crimping and sealing ferrule that is disposed onto an outer insulating jacket of a multiple outer conductor coaxial cable and includes inner and outer annular recesses in which are disposed sealing members; a strain relief section of the ferrule is crimpable onto the outer jacket and an outer conductor of the outer conductors of the cable is bent back along an outer surface of the ferrule. A center contact is crimpable onto a center conductor of the cable and is insertable into a bore of an inner dielectric member of an inner contact assembly and secured therein, whereafter an inner conductor of the outer conductors of the cable is crimpable onto an inner contact of the inner contact assembly thereby forming a terminated inner contact assembly. The terminated inner contact assembly is then insertable into a bore of an outer dielectric member of an outer contact assembly and secured therein while the crimping and sealing ferrule extends along a crimping ferrule section of the outer contact assembly, the crimping ferrule section being crimpable onto the crimping and sealing ferrule with the outer conductor of the outer conductors electrically connected therebetween, and the sealing members form inner and outer seals on the cable.

17 Claims, 10 Drawing Figures

COAXIAL ELECTRICAL CONNECTOR FOR MULTIPLE OUTER CONDUCTOR COAXIAL CABLE

FIELD OF THE INVENTION

This invention relates to electrical connectors and more particularly to coaxial electrical connectors for multiple outer conductor coaxial cables.

BACKGROUND OF THE INVENTION

Coaxial electrical connectors are known to terminate multiple outer conductor coaxial cables. These connectors contain a large number of parts and many of them use solder to terminate the center contacts and/or the outer contacts respectively to the center and outer conductors of the coaxial cable. The sealing arrangement has not proven satisfactory and the strain relief has not satisfactorily protected the termination. The connection area between the outer contacts has not been as effective as it should be to shield the center contact connection.

Accordingly, a need has been established for a suitable coaxial electrical connector for termination to a stripped end of a multiple outer conductor cable that has less parts, that is of simplified structure, that is easily crimpable onto the center and outer conductors of the cable, that has excellent sealing features coupled with optimum strain relief construction, and that has excellent electrical connection between the outer contacts and outer conductors.

SUMMARY OF THE INVENTION

According to the present invention, a coaxial electrical connector comprises a crimping and sealing ferrule that is disposed onto an outer insulating jacket of a multiple outer conductor coaxial cable and includes inner and outer annular recesses in which are disposed sealing members; a strain relief section of the ferrule is crimpable onto the outer jacket and an outer conductor of the outer conductors of the cable is bent back along an outer surface of the ferrule. A center contact is crimpable onto a center conductor of the cable and is insertable into a bore of an inner dielectric member of an inner contact assembly and secured therein, whereafter an inner conductor of the outer conductors of the cable is crimpable onto an inner contact of the inner contact assembly thereby forming a terminated inner contact assembly. The terminated inner contact assembly is then insertable into a bore of an outer dielectric member of an outer contact assembly and secured therein while the crimping and sealing ferrule extends along a crimping ferrule section of the outer contact assembly, the crimping ferrule section being crimpable onto the crimping and sealing ferrule with the outer conductor of the outer conductors electrically connected therebetween, and the sealing members form inner and outer seals on the cable.

According to another embodiment of the invention, a gold-plated ring is secured in the outer contact assembly to secure the outer dielectric member in position and the gold-plated ring is electrically engageable with a complementary gold-plated ring in a complementary coaxial electrical connector when the complementary connectors are matably connected together.

DETAILED DESCRIPTION OF THE INVENTION

Figure 1:
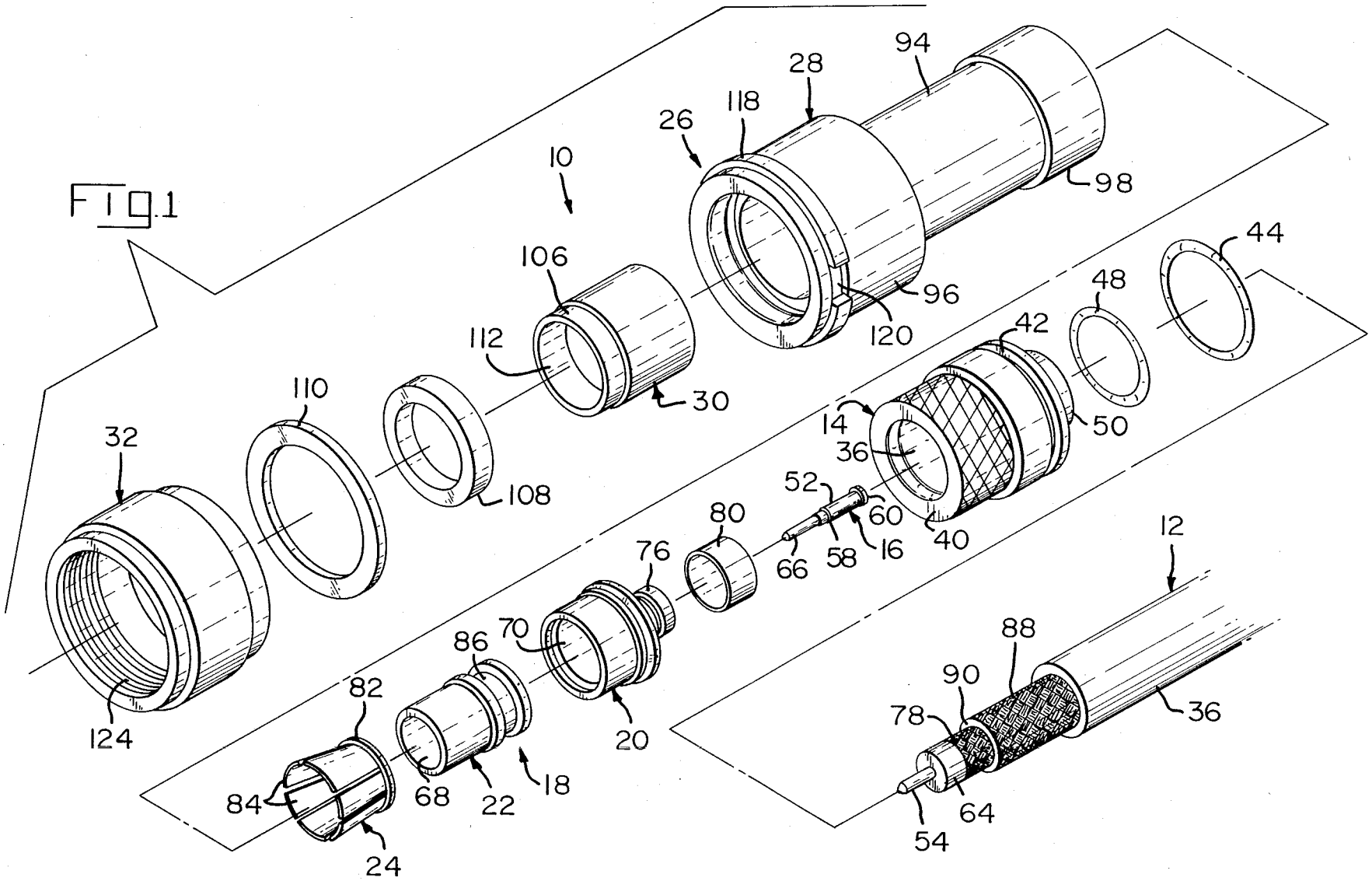
FIG. 1 is an exploded and perspective view of the parts of an electrical coaxial plug connector and the stripped multiple outer conductor coaxial cable to which it is to be terminated.
Figure 2:
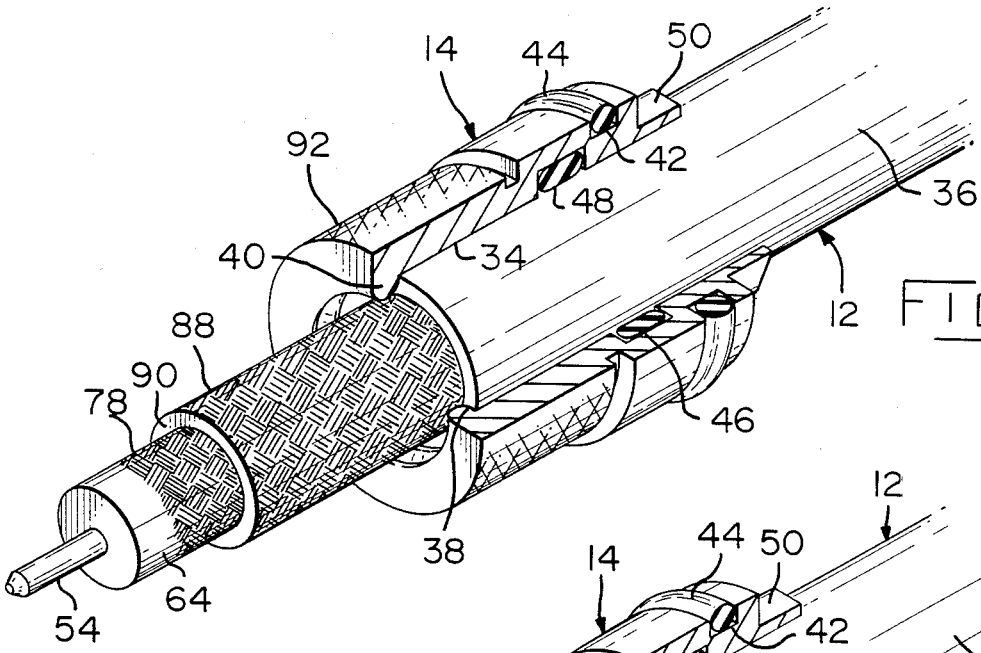
FIGS. 2 through 5 are perspective views showing the various parts and assemblies with parts broken away of the coaxial plug connector that are assembled to terminate the center and outer conductors of the coaxial cable.
Figure 3:
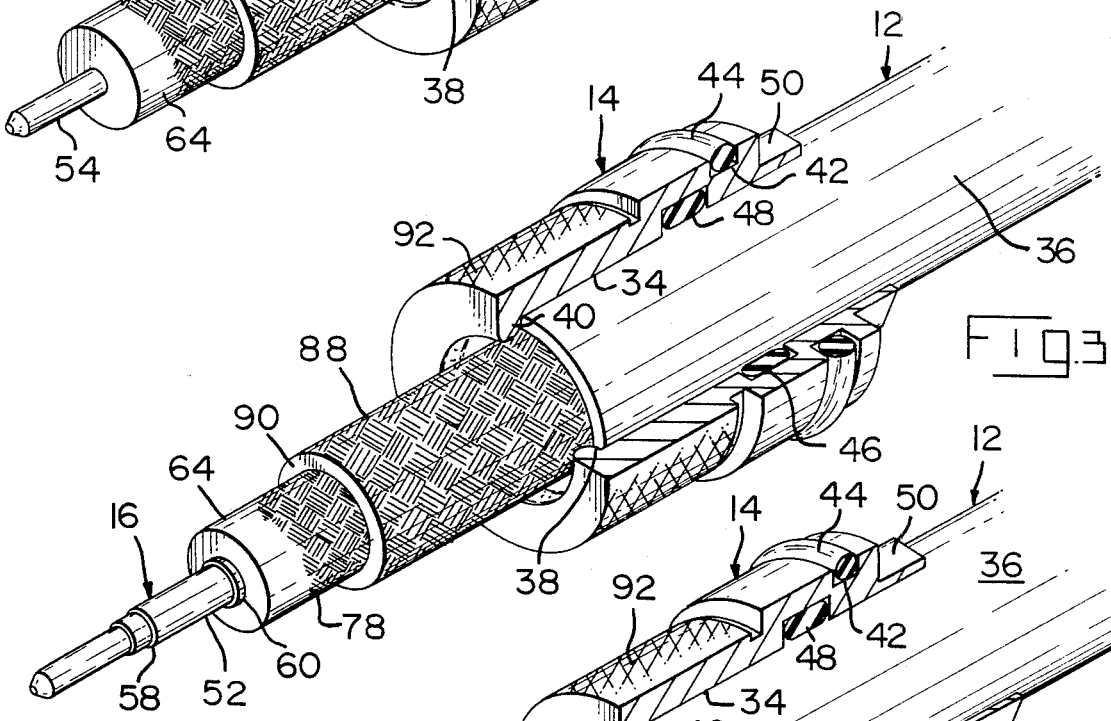
Figure 4:
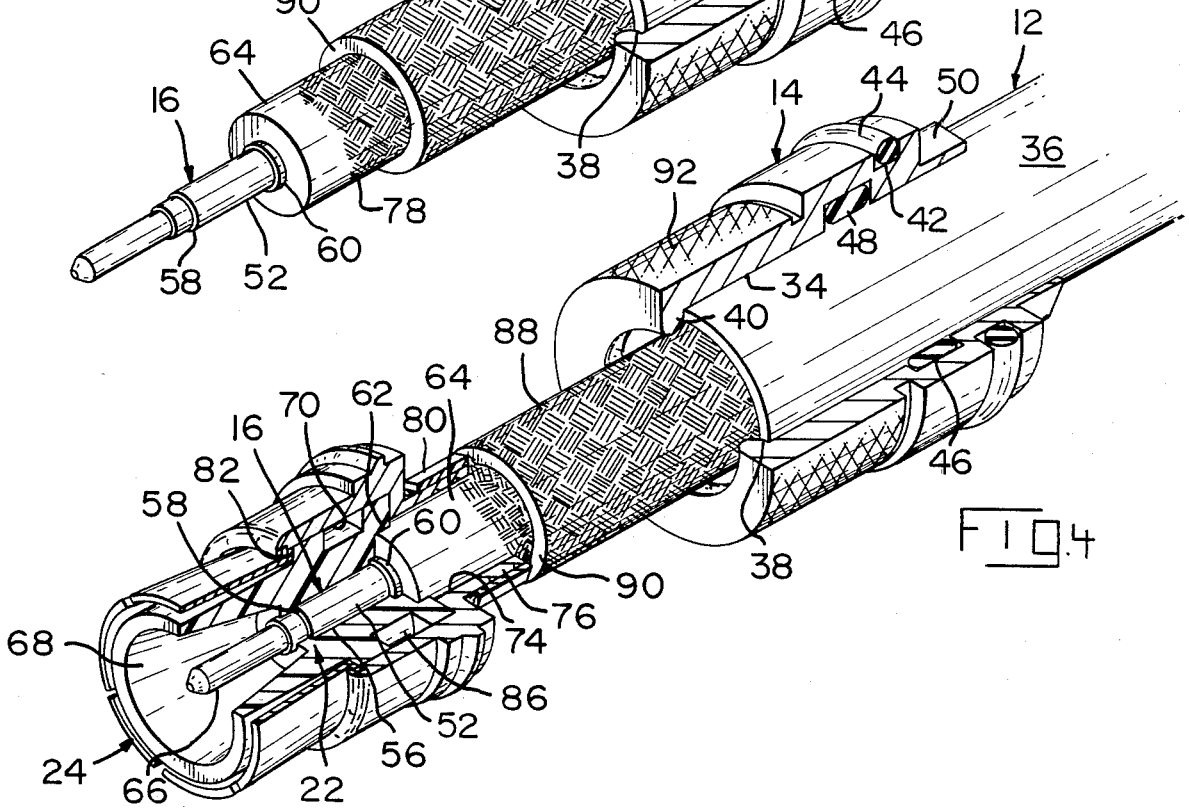

FIG. 1 shows the various parts exploded from one another of a coaxial electrical connector 10 which is to be terminated onto a stripped end of a multiple outer conductor cable 12 which is commonly referred to as triaxial cable. Coaxial connector 10 includes a crimping and sealing ferrule 14, a center contact member 16, an inner contact assembly 18, an inner contact member 20, an inner dielectric member 22, and a spring contact member 24. Outer contact assembly 26 includes an outer contact member 28, an outer dielectric member 30, and a coupling member 32.

Crimping and sealing ferrule 14 as shown in FIGS. 2 through 5 and 7 has a bore 34 of a diameter to freely receive an outer insulating jacket 36 of coaxial cable 12 therein as shown in FIGS. 2 through 5 and 7. As can be discerned, insulating jacket 36 extends to a stop surface 38 which is formed by an inwardly-directed annular projection 40 through which the other parts of coaxial cable 12 extend. An external annular recess 42 has an O-ring sealing member 44 disposed therein and an internal annular recess 46 is in communication with bore 34 and it has an O-ring sealing member 48 therein. A strain relief ferrule section 50 of crimping and sealing ferrule 14 is crimpable onto insulating jacket 36 to provide strain relief to absorb the bending, torsion, and tensile forces exterted on cable 12 as well as to maintain the integrity of sealing members 44 and 48.

With crimping and sealing ferrule 14 positioned onto jacket 36 of cable 12 via sealing member 48 in sealing engagement with jacket 36, ferrule section 52 of center contact member 16 is inserted onto center conductor 54 of cable 12 and crimped thereto by a conventional crimping tool (not shown). Crimped center contact member 16 is then inserted into a bore 56 of inner dielectric member 22 and is secured therein by a barb 58 which bites into the dielectric material to secure center contact member 16 therein and prevent its withdrawal therefrom as a result of its configuration including a tapered leading edge and a perpendicular following edge. Annular flange 60 at the outer end of center contact member 16 abuts against inner dielectric member 20 within annular recess 62 thereof in which an end of insulation sheath 64 surrounding center conductor 54 is disposed. A pin contact section 66 of center contact member 16 is disposed within a frustoconical cavity 68 in the front end of inner dielectric member 22.

Figure 7:
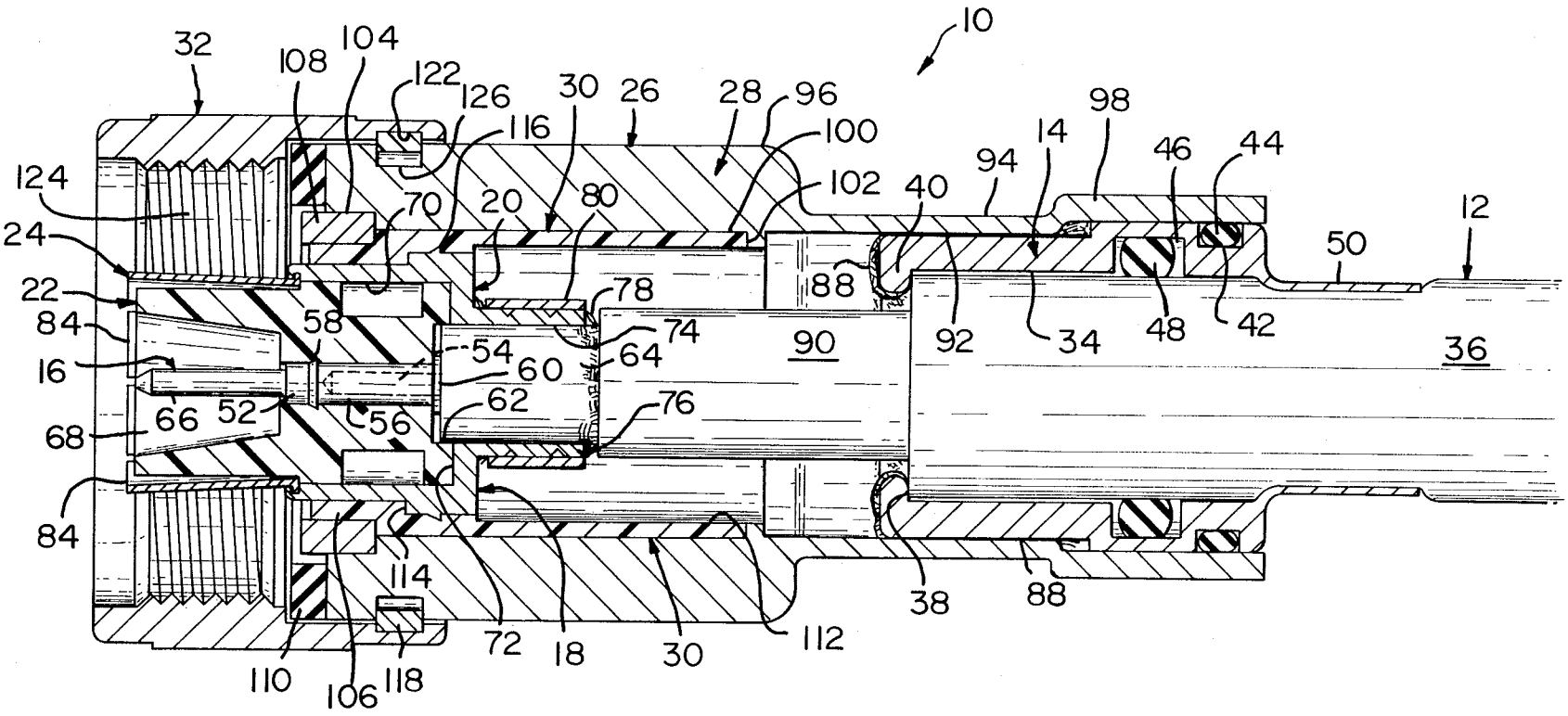
FIG. 7 is a cross-sectional view of the coaxial plug connector of FIG. 6.

As can be discerned from FIG. 7, inner dielectric member 22 is disposed within a first bore 70 of inner contact member 20 and engages inner surface 72 to limit its inner movement therein. Annular recess 62 of inner dielectric member 22 is substantially coincident with bore 74 of ferrule section 76 so that insulation sheath 64 extends through bore 74. An inner braided conductor 78 of the multiple outer conductors of cable 12 is disposed on ferrule section 76 and a crimping ferrule 80 is crimped onto ferrule section 76 by a conventional crimping tool (not shown) to mechanically and electrically connect inner conductor 78 therebetween in accordance with conventional crimping practices. A flange 82 of spring contact member 24 is secured to the front end of inner contact member 20 by rolling over the front edge thereof into engagement with flange 82 to mechanically and electrically secure spring contact member 24 to inner contact member 20 and to secure inner dielectric member 22 in position in first bore 70 as shown in FIG. 7. Spring contact member 24 has spring segment 84. An annular recess 86 is located in inner dielectric member 22 for impedance matching purposes.

Figure 5:
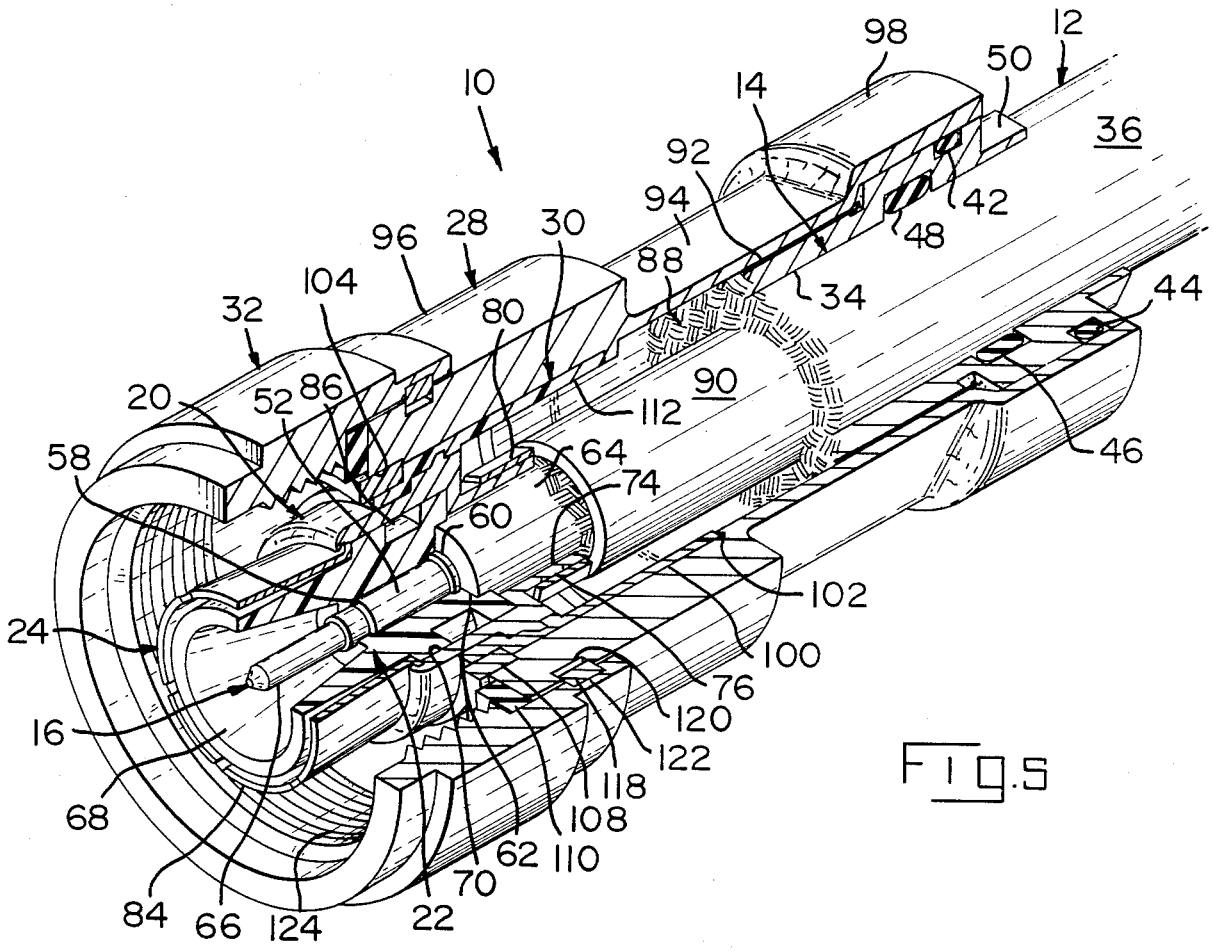
Figure 6:
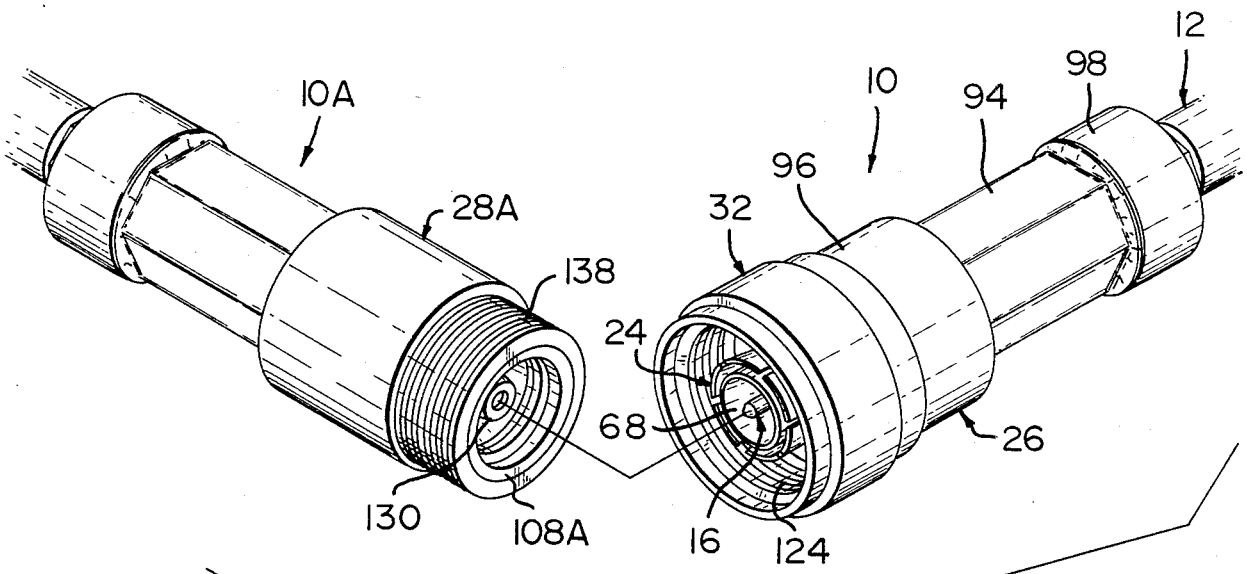
FIG. 6 is a perspective and exploded view of the plug and jack coaxial connectors terminated onto ends of multiple outer conductor coaxial cables.

With crimping and sealing ferrule 14 positioned onto outer insulating jacket 36 of cable 12, with inner contact member 16 terminated onto center conductor 54 and secured in position in bore 56 of inner dielectric member 22, and with inner conductor 78 terminated onto inner contact member 20, outer braided conductor 88 of the multiple outer conductors which is disposed on dielectric sheath 90 is folded back over a crimping section 92 of ferrule 14 as shown in FIG. 5; this assembly is now inserted within outer contact assembly 26 with inner contact assembly 18 secured within outer dielectric member 30 and crimping section 92 with outer conductor 88 folded back thereover is disposed within a crimping ferrule section 94 of outer contact member 28 which is a recessed area between a front section 96 and a rear section 98 of outer contact member 28 whereafter a conventional crimping tool (not shown) is used to crimp crimping ferrule section 94 onto crimping section 92 of crimping and sealing ferrule 14 thereby mechanically and electrically connecting outer conductor 88 therebetween. Strain relief ferrule section 50 is then crimped onto outer jacket 36. If desired, ferrule section 94 and ferrule section 50 can be crimped simultaneously. O-ring sealing member 44 sealingly engages the inner surface of rear section 98 of outer contact member 28 while sealing member 48 sealingly engages outer insulating jacket 36 of cable 12 preventing moisture from entering into the interior of the connector. The outer surface of crimping section 92 is knurled to increase the tensile and torsion characteristics of the crimped connection between ferrule 14 and ferrule section 94 as well as providing an improved electrical connection with outer conductor 88.

As can be discerned from FIG. 7, outer dielectric member 30 is positioned within a bore 100 within outer contact member 28 which terminates at a stop surface 102 against which the inner end of outer dielectric member 30 engages to limit movement within bore 100. At the forward end of outer contact member 28, bore 100 steps into a larger diameter section 104 in which a stepped section 106 of outer dielectric member 30 is disposed. A gold-plated metal ring 108, preferably of brass, is force-fitted into larger diameter section 104 and engages the inner end of stepped section 106 of outer dielectric member 30 to secure member 30 in position within bore 100 of outer contact member 28. A sealing ring member 110 is disposed outwardly from ring 108 in engagement with the front surface of outer contact member 28.

A front section of inner contact member 20 is disposed along bore 112 of outer dielectric member 30 while an intermediate section of inner contact member 20 is disposed within an intermediate section of bore 112 and is secured therein against a stop surface 114 by annular barb 116 located on an exterior surface of the intermediate section of inner contact member 20 which digs into the dielectric material of outer dielectric member 30 to secure inner contact assembly in position within dielectric member 30 as shown in FIG. 7. Barb 116 has the same configuration as that of barb 58 of center contact member 16.

Coupling member 32 is freely and rotatably mounted on outer contact member 28 by a metal split spring ring 118 which is disposed within opposing recesses 120, 122 respectively located in the outer surface of outer contact member 28 and an inner surface of coupling member 32. Threads 124 are located along the internal front surface of coupling member 32 and also serve to maintain sealing ring member 110 in position.

Figure 10:
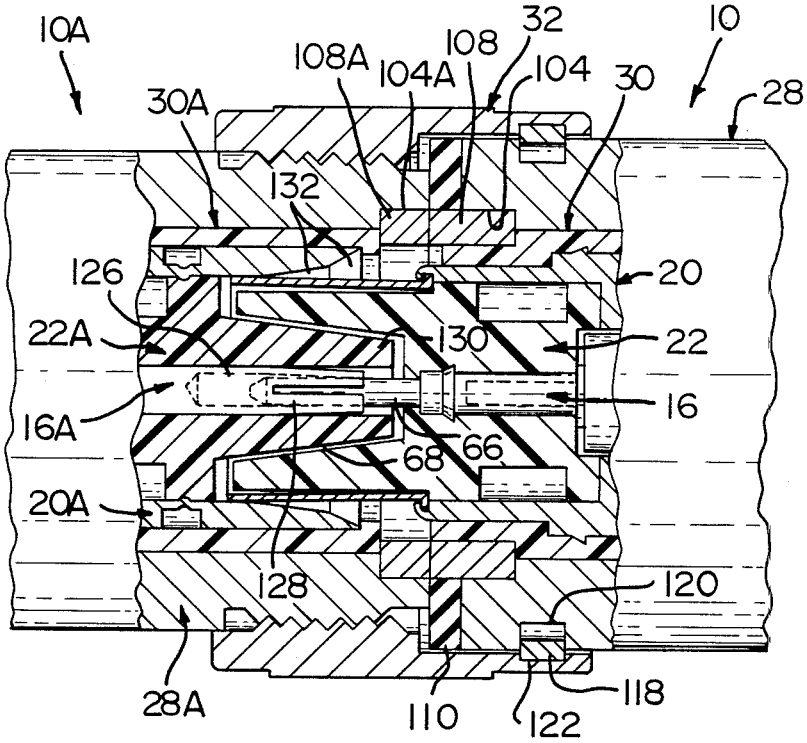
FIG. 10 is a part cross-sectional view of the electrically connected plug and jack coaxial connectors.
Figure 9:
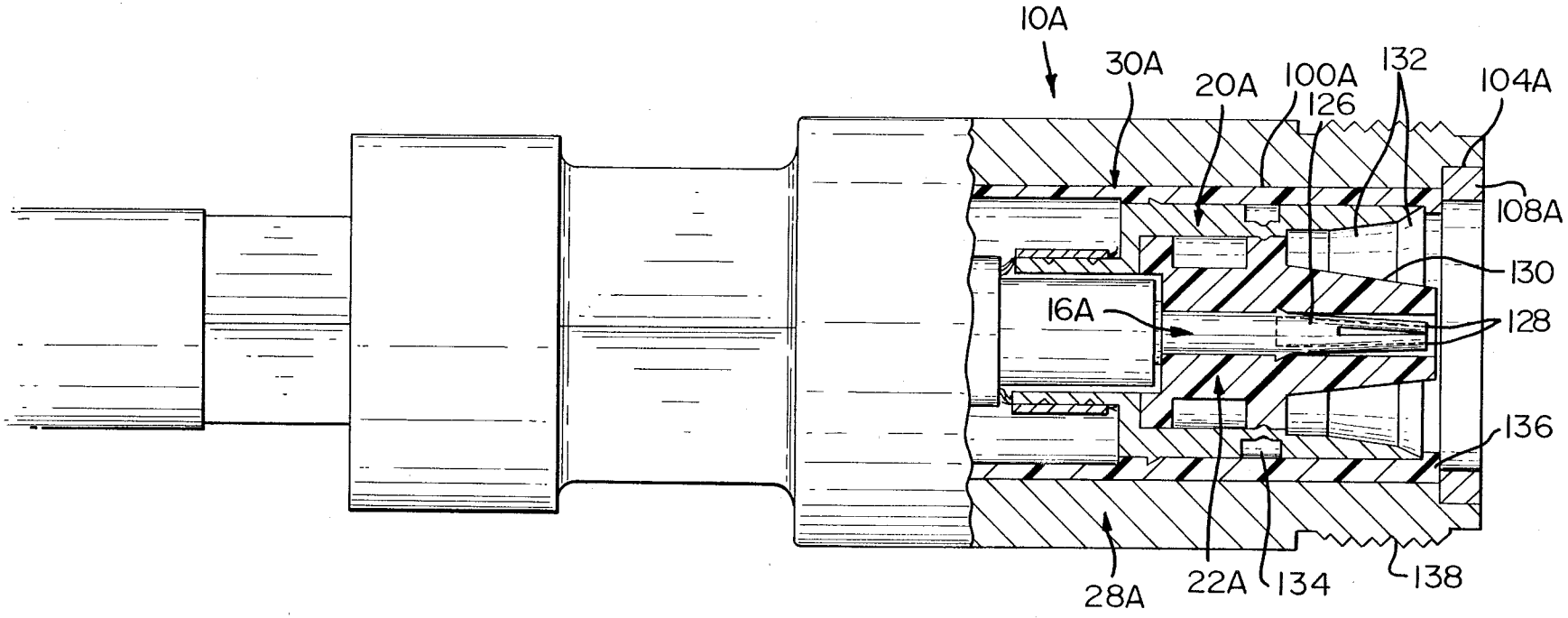
FIG. 9 is a part cross-sectional view of the coaxial jack connector of FIG 6.

FIG. 9 shows the coaxial jack connector 10A which is electrically connectable and matable with coaxial plug connector 10 as shown in FIG. 10; all of the parts of coaxial jack connector 10A are the same as coaxial plug connector 10 with the following exceptions, and they will be the only ones that will be described. Center contact member 16A has a receptacle contact section 126 having spring contact members 128 for electrical connection with pin contact section 66 of center contact member 16. Inner dielectric member 22A has a frustoconical section 130 surrounding receptacle contact section 126 and is disposed within frustoconical cavity 68 of inner dielectric member 22. Section 130 protects spring contact members 128. Inner contact member 20A is an integral member and the front section thereof has internal tapered surfaces 132 along which spring segments 84 of spring contact member 24 electrically engage. An annular recess 134 is provided in the external surface of inner contact member 20A so that a tool (not shown) can be inserted therein to deform inner contact member 20A in this particular area to secure inner dielectric member 22A in position within inner contact member 20A. The front end of outer dielectric member 30A has an annular flange 136 against which the front end of inner contact member 20A engages to limit inner movement thereof within outer dielectric member 30A. Gold-plated metal ring 108A is press-fit into larger diameter section 104A of bore 100A against the front end of outer dielectric member 30A to secure outer dielectric member 30A in position in bore 100A and the outer surface of ring 108A is coincident with the front surface of outer contact member 28A so that when coaxial plug connector 10 is electrically connected with coaxial jack connector 10A by means of threads 124 of coupling member 32 threadably engaging threads 138 on outer contact member 28A, gold-plated metal rings 108 and 108A are in electrical engagement as shown in FIG. 9 thereby providing an excellent electrical connection therebetween. The front end of outer contact member 28A engages sealing ring member 110 to form a sealed connection between outer contact members 28 and 28A which also protects the other connections between inner contact members 20 and 20A and center contact member 16 and 16A.

Figure 8:
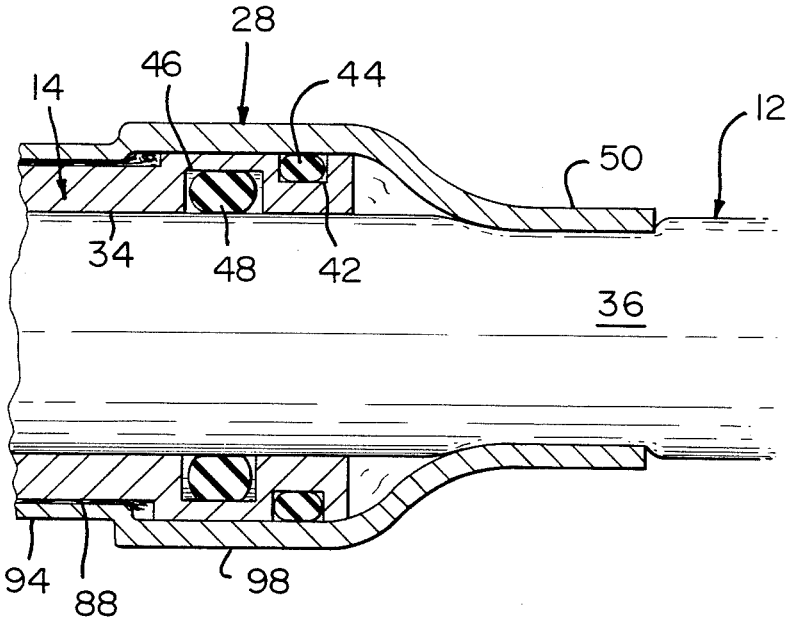
FIG. 8 is a part cross-sectional view of an alternative embodiment.

The center contact members 16 and 16A can be gold plated if desired. A conductive foil can be disposed under each of braided outer conductors 78 and 88. Ferrule section 50 can be part of outer contact member 28 instead of ferrule 14 as shown in FIG. 8. The reason for this is to extend the radius of bending of cable 12 outwardly from the sealing effected by sealing rings 44 and 48, especially if cable 12 will undergo undue bending and twisting stresses. The crimps to crimping ferrule 80 and crimping ferrule section 94 are preferably of hexagonal configuration which can also be applied to the ferrule section 52 of center contact member 16. Ferrule section 50 of ferrule 14 can be crimped onto jacket 36 to secure ferrule 14 onto cable 12 prior to ferrule 14 being inserted within outer contact member 28.

As can be discerned, a coaxial connector for easy termination onto a center conductor and multiple outer conductors of a coaxial cable has been described including a method for connecting such coaxial connector to a center conductor and multiple outer conductors of a coaxial cable.

We claim:

1. A coaxial electrical connector of the type wherein for connection with a center conductor and multiple outer conductors of a coaxial cable, the connector comprises a center contact member securable onto the center conductor and positionable within a bore of an inner dielectric member of an inner contact assembly, an inner contact member of the inner contact assembly to which is electrically connectable an inner conductor of the multiple outer conductors, an outer contact assembly including an outer dielectric member having a bore in which the inner contact assembly is disposed and an outer contact member to which an outer conductor of the multiple outer conductor is electrically connectable, the connector comprising:

a crimping and sealing ferrule positionable onto an outer jacket of the cable and having a sealing member disposed within an inner recess of the crimping and sealing ferrule forming a seal between the ferrule and the outer jacket of the cable;

a crimping ferrule member, crimpably connecting the inner conductor of the multiple outer conductors to the inner contact member of the inner contact assembly and the inner contact assembly containing the center contact member terminated to the center conductor and positioned in the bore of the inner dielectric member and the inner conductor terminated to the inner contact member being positioned within the bore of the outer dielectric member and the crimping and sealing ferrule sealingly positioned on the outer jacket of the cable being positioned within the outer contact member and the outer contact member being crimpable onto the crimping and sealing ferrule with the outer conductor captured therebetween; and sealing means disposed between said crimping and sealing ferrule and said crimping ferrule member for sealing the same.

2. A coaxial electrical connector as set forth in claim 1, wherein said crimping and sealing ferrule has a stop surface against which the outer jacket engages to limit movement of the cable therewithin.

3. A coaxial electrical connector as set forth in claim 1, wherein a securing barb on said center contact member and said inner contact member secures respectively the center contact member in the bore of said inner dielectric member and the inner contact member in the bore of the outer dielectric member.

4. A coaxial electrical connector as set forth in claim 1, wherein said crimping and sealing ferrule has a crimping section along which the outer conductor is bent back along prior to being crimped between said crimping and sealing ferrule and said outer contact member.

5. A coaxial electrical connector as set forth in claim 4 wherein said crimping section is knurled.

6. A coaxial electrical connector of the type wherein for connection with a center conductor and multiple outer conductors of a coaxial cable, the connector comprises a center contact member securable onto the center conductor and positionable within a bore of an inner dielectric member of an inner contact assembly, an inner contact member of the inner contact assembly to which is electrically connectable an inner conductor of the multiple outer conductors, an outer contact assembly including an outer dielectric member having a bore in which the inner contact assembly is disposed and an outer contact member to which an outer conductor of the multiple outer conductor is electrically connectable, the connector comprising:

a crimping and sealing ferrule positionable onto an outer jacket of the cable and having a sealing member disposed within an inner recess of the crimping and sealing ferrule forming a seal between the ferrule and the outer jacket of the cable; and a crimping ferrule member, crimpably connecting the inner conductor of the multiple outer conductors to the inner contact member of the inner contact assembly and the inner contact assembly containing the center contact member terminated to the center conductor and positioned in the bore of the inner dielectric member and the inner conductor terminated to the inner contact member being positioned within the bore of the outer dielectric member and the crimping and sealing ferrule sealingly positioned on the outer jacket of the cable being positioned within the outer contact member and the outer contact member being crimpable onto the crimping and sealing ferrule with the outer conductor being captured therebetween; and wherein said crimping and sealing ferrule has an external annular recess in which another sealing member is disposed to form a seal between the outer contact member and the crimping and sealing ferrule.

7. A coaxial electrical connector of the type wherein for connection with a center conductor and multiple outer conductors of a coaxial cable, the connector comprises a center contact member securable onto the center conductor and positionable within a bore of an inner dielectric member of an inner contact assembly, an inner contact member of the inner contact assembly to which is electrically connectable an inner conductor of the multiple outer conductors, an outer contact assembly including an outer dielectric member having a bore in which the inner contact assembly is disposed and an outer contact member to which an outer conductor of the multiple outer conductor is electrically connectable, the connector comprising:

a crimping and sealing ferrule positionable onto an outer jacket of the cable and having a sealing member disposed within an inner recess of the crimping and sealing ferrule forming a seal between the ferrule and the outer jacket of the cable wherein said crimping and sealing ferrule has a strain relief ferrule section crimpable onto the outer jacket of the cable;

a crimping ferrule member crimpably connecting the inner conductor of the multiple outer conductors to the inner contact member of the inner contact assembly and the inner contact assembly containing the center contact member terminated to the center conductor and positioned in the bore of the inner dielectric member and the inner conductor terminated to the inner contact member being positioned within the bore of the outer dielectric member and the crimping and sealing ferrule sealingly positioned on the outer jacket of the cable being positioned within the outer contact member and the outer contact member being crimpable onto the crimping and sealing ferrule with the outer conductor captured therebetween;

sealing means disposed between said crimping and sealing ferrule and said crimping ferrule member for sealing the same.

8. A coaxial electrical connector of the type wherein for connection with a center conductor and multiple outer conductors of a coaxial cable, the connector comprises a center contact member securable onto the center conductor and positionable within a bore of an inner dielectric member of an inner contact assembly, an inner contact member of the inner contact assembly to which is electrically connectable an inner conductor of the multiple outer conductors, an outer contact assembly including an outer dielectric member having a bore in which the inner contact assembly is disposed and an outer contact member to which an outer conductor of the multiple outer conductor is electrically connectable, the connector comprising a crimping and sealing ferrule positionable onto an outer jacket of the cable and having a sealing member disposed within an inner recess of the crimping and sealing ferrule forming a seal between the ferrule and the outer jacket of the cable;

a crimping ferrule member crimpably connecting the inner conductor of the multiple outer conductors to the inner contact member of the inner contact assembly and the inner contact assembly containing the center contact member terminated to the center conductor and positioned in the bore of the inner dielectric member and the inner conductor terminated to the inner contact member being positioned within the bore of the outer dielectric member and the crimping and sealing ferrule sealingly positioned on the outer jacket of the cable being positioned within the outer contact member and the outer contact member being crimpable onto the crimping and sealing ferrule with the outer conductor captured therebetween;

sealing means disposed between said crimping and sealing ferrule and said crimping ferrule member for sealing the same; and wherein a gold plated sealing ring is press-fitted into a recess on a front surface of the outer contact member to secure said outer dielectric member in said outer contact member and to electrically connect with a complementary coaxial electrical connector.

9. A coaxial electrical connector for termination onto a center conductor and multiple outer conductors of a coaxial cable, comprising:

center contact means electrically connectable with the center conductor;

crimping and sealing ferrule means for disposition on an outer jacket of the coaxial cable and having sealing means disposed within an internal recess along which the coaxial cable extends, said sealing means sealingly engageable with the outer jacket, said crimping and sealing ferrule means having crimping section means along which an outer conductor of the multiple outer conductors is to be positioned;

inner contact assembly means including inner contact means having inner dielectric means secured therein and ferrule section means along which an inner conductor of the multiple outer conductors is to be positioned, said inner dielectric means having a bore in which said center contact means is disposed, crimping member means for crimping the inner conductor to said ferrule section means; and outer contact assembly means including outer contact means having outer dielectric means secured therein and ferrule member means, said inner contact assembly means with said center contact means disposed in said bore and the inner conductor crimped to said ferrule section means being disposed in said outer dielectric means and said crimping and sealing ferrule means having sealing means disposed between said crimping and sealing means and the outer jacket and between said crimping and sealing means and said ferrule member means, and the outer conductor positioned along said crimping section means being disposed along said ferrule member means so that said ferrule member means is crimpable onto said crimping section means thereby connecting the outer conductor between the ferrule member means and said crimping section means.

10. A coaxial electrical connector as set forth in claim 9, wherein said center contact means and said inner contact means have barb means for respectively securing said center contact means in the bore of said inner dielectric means and in said outer dielectric means.

11. A coaxial electrical connector for termination onto a center conductor and multiple outer conductors of a coaxial cable, comprising:

center contact means electrically connectable with the center conductor;

crimping and sealing ferrule means for disposition on an outer jacket of the coaxial cable and having sealing means disposed within an internal recess along which the coaxial cable extends, said sealing means sealingly engageable with the outer jacket, said crimping and sealing ferrule means having crimping section means along which an outer conductor of the multiple outer conductors is to be positioned;

inner contact assembly means including inner contact means having inner dielectric means secured therein and ferrule section means along which an inner conductor of the multiple outer conductors is to be positioned, said inner dielectric means having a bore in which said center contact means is disposed, crimping member means for crimping the inner conductor to said ferrule section means; and outer contact assembly means including outer contact means having outer dielectric means secured therein and ferrule member means, said inner contact assembly means with said center contact means disposed in said bore and the inner conductor crimped to said ferrule section means being disposed in said outer dielectric means and said crimping and sealing ferrule means sealingly disposed on the outer jacket and the outer conductor positioned along said crimping section means being disposed along said ferrule member means so that said ferrule member means is crimpable onto said crimping section means thereby connecting the outer conductor between the ferrule member means and said crimping section means; wherein another sealing means is disposed in external recess means of said crimping and sealing means to sealingly engage said ferrule section means when said crimping and sealing ferrule means is disposed therein.

12. A coaxial electrical connector as set forth in claim 9, wherein strain relief ferrule means extends outwardly from said crimping and sealing ferrule means for crimping onto the outer jacket.

13. A coaxial electrical connector as set forth in claim 9, wherein strain relief ferrule means extends outwardly from said outer contact means for crimping onto the outer jacket.

14. A coaxial electrical connector as set forth in claim 9, wherein gold-plated ring means is secured in recess means in a front surface of said outer contact means for electrical connection with complementary gold-plated ring means of a complementary coaxial electrical connector.

15. A coaxial electrical connector for termination onto a center conductor and multiple outer conductors of a coaxial cable, comprising:

a center contact member electrically connectable to the center conductor;

an inner contact assembly including an inner contact member and an inner dielectric member, means securing said inner dielectric member in said inner contact member, said inner dielectric member having a bore in which said center contact member connected to the center conductor is to be disposed, said inner contact member having a ferrule section along an inner surface of which is to extend an inner insulation surrounding the center conductor of the coaxial cable and along an outer surface of which an inner conductor of the multiple outer conductors is to extend, and a crimping ferrule crimpable onto the ferrule section thereby electrically connecting the inner conductor to the ferrule section;

an outer contact assembly including an outer contact member and an outer dielectric member, means securing said outer dielectric member in said outer contact member, said outer dielectric member having a passageway in which said inner contact assembly is to be secured, said outer contact member including a crimping section and sealing section means;

a crimping ferrule member onto which an outer conductor of the multiple outer conductors is to be disposed and onto which said crimping section is crimpable thereby electrically connecting the outer conductor therebetween, with said seaing section means being extendible along an outer jacket of the coaxial cable; and sealing means disposed between an inner surface of said crimping ferrule member and the outer jacket of the coaxial cable thereby forming a seal therebetween, said sealing means being further disposed between an outer surface of said crimping ferrule member and said outer contact member thereby forming a seal therebetween.

16. A coaxial electrical connector for termination onto a center conductor and multiple outer conductors of a coaxial cable, comprising:

a center contact member electrically connectable to the center conductor;

an inner contact assembly including an inner contact member and an inner dielectric member, means securing said inner dielectric member in said inner contact member, said inner dielectric member having a bore in which said center contact member connected to the center conductor is to be disposed, said inner contact member having a ferrule section along an inner surface of which is to extend an inner insulating material surrounding the center conductor of the coaxial cable and along an outer surface of which an inner conductor of the multiple outer conductors is to extend, and a crimping ferrule crimpable onto the ferrule section thereby electrically connecting the inner conductor to the ferrule section;

an outer contact assembly including an outer contact member and an outer dielectric member, means securing said outer dielectric member in said outer contact member, said outer dielectric member having a passageway in which said inner contact assembly is to be secured, said outer contact member including a crimping section and sealing section means;

a crimping ferrule member onto which an outer conductor of the multiple outer conductors is to be disposed and onto which said crimping section is crimpable thereby electrically connecting the outer conductor therebetween and wherein said sealing section means is extendible along an outer jacket of the coaxial cable; and wherein said crimping ferrule member is extendible along the outer jacket and the outer conductor is bent back over the crimping ferrule member and said crimping ferrule member includes annular recesses in inner and outer surfaces thereof, sealing ring members disposed in said inner and outer recesses and sealingly engageable respectively with the outer jacket and an inside surface of said sealing section means.

17. A coaxial electrical connector for termination onto a center conductor and multiple outer conductors of a coaxial cable, comprising:

a center contact member electrically connectable to the center conductor;

an inner contact assembly including an inner contact member and an inner dielectric member, means securing said inner dielectric member in said inner contact member, said inner dielectric member having a bore in which said center contact member connected to the center conductor is to be disposed, said inner contact member having a ferrule section along an inner surface of which is to extend an inner insulation surrounding the center conductor of the coaxial cable and along an outer surface of which an inner conductor of the multiple outer conductors is to extend, and a crimping ferrule crimpable onto the ferrule section thereby electrically connecting the inner conductor to the ferrule section;

an outer contact assembly including an outer contact member and an outer dielectric member, means securing said outer dielectric member in said outer contact member, said outer dielectric member having a passageway in which said inner contact assembly is to be secured, said outer contact member including a crimping section and sealing section means;

a crimping ferrule member onto which an outer conductor of the multiple outer conductors is to be disposed and onto which said crimping section is crimpable thereby electrically connecting the outer conductor therebetween, and with said sealing section means being extendible along an outer jacket of the coaxial cable; and a pair of sealing means disposed between an inner surface of said sealing section means and said crimping ferrule member and between the crimping ferrule member and the outer jacket of the coaxial cable thereby forming a seal therebetween; wherein said sealing section means has a strain relief ferrule section crimpable onto the outer jacket of the coaxial cable.

* * * * *